United States Patent [19]

Beisswanger

[11] Patent Number: 4,881,695

[45] Date of Patent: Nov. 21, 1989

[54] UNWINDING APPARATUS FOR PAPER OR BOARD WEB ROLLS

[75] Inventor: Rudolf Beisswanger, Steinheim, Fed. Rep. of Germany

[73] Assignee: J.M. Voith GmbH, Heidenheim, Fed. Rep. of Germany

[21] Appl. No.: 220,327

[22] Filed: Jul. 18, 1988

[30] Foreign Application Priority Data

Jul. 17, 1987 [DE] Fed. Rep. of Germany ..... 3723601

[51] Int. Cl.[4] ..... B65H 19/18; B65H 19/20

[52] U.S. Cl. ..... 242/58.4; 242/58.6; 242/58.3; 156/502

[58] Field of Search ..... 242/58.1–58.6; 156/502, 504, 506

[56] References Cited

U.S. PATENT DOCUMENTS 3,841,944 10/1974 Harris ..... 242/58.4 X
3,858,819 1/1975 Butler, Jr. ..... 242/58.4 X
4,564,413 1/1986 Murakami ..... 242/58.4 X
4,668,328 5/1987 Kyytsönen ..... 242/58.4 X

*Primary Examiner*—Stuart S. Levy
*Assistant Examiner*—Steven M. duBois
*Attorney, Agent, or Firm*—Albert L. Jeffers; Richard L. Robinson

[57] ABSTRACT

An intermittently operating unwinding apparatus has a separating device with which a web-end is formed on the lifting-out of an empty spool from the guide ways of an unwind unit. A holding device holds the web-end in a plane which extends parallel to the guide ways, on which a new winding roll located in waiting position rests with its roll axle. The machine has a splicing unit with a cross member arranged parallel to the guide ways to which the beginning of the web of the new parent roll can be joined. During transport of the new parent roll out of the waiting position into its unwinding position the splicing unit is moved by dogs engaging at the roll axle against the holding device and the web-beginning joined to the web-end.

12 Claims, 2 Drawing Sheets

UNWINDING APPARATUS FOR PAPER OR BOARD WEB ROLLS

BACKGROUND OF THE INVENTION

The invention relates to an unwinding apparatus for paper or board web rolls or the like integrated with a succeeding rewind station, such as a two drum winder, a single drum winder, or the like.

Such an unwinding apparatus is known from U.S. Pat. No. 3,327,959. On it, an expiring winding roll (empty spool) is exchanged for a new, full roll (parent roll) while the web is being pulled off the winding roll at reduced speed. In the process the expiring roll is lifted out of the unwinding position and the new parent roll is conveyed out of its waiting position into the unwinding position. The web continuing to be unwound from the roll in the new position is led around a guide roll, which extends close along the periphery of the new parent roll in the unwinding position. The new web beginning on the parent roll is given an application of adhesive to attach the beginning of the web to the expiring web of the empty spool. For this purpose the peripheral speed of the parent roll must be matched to that of the unwinding web. Shortly before the web material on the spool has been completely unwound, the guide roll is swung against the periphery of the new, rotating parent roll in order to being the end of the unwound web in contact with the splicing point of the parent roll. When the splice has been made, a separating device separates the expiring web, which carries the beginning of the web along onto the new parent roll. The empty spool is now lifted out of its position and deposited in a storage means out of which it can be taken with a hoist.

To be capable of performing such an exchange of the empty spool for a new parent roll, the known unwinding apparatus is designed relatively expensively: guideways and drive means must be provided to convey the expiring roll out of the unwinding position. The succeeding new parent roll brought into the unwinding position is synchronized by means of a drive with the speed of the unwound web. Furthermore, a sophisticated machine control system is provided to perform the splicing operation. Nevertheless, with the known device, uncontrolled web doublings of differing lengths occur during the splicing operation, which may lead to troubles with the subsequent processing of the web.

In the case of winding machines in which, for example, after a longitudinal slit of the unwound web, the web is wound up on two drums or single drums into rolls which are relatively large in diameter, it is necessary, on completion of these rolls, to stop the machine so that the rolls can be taken out of the machine. Completion of the rolls is arranged in such a way that during such a stop an empty spool can be exchanged for a new parent roll. The time advantage obtained with the aforementioned known unwinding apparatus decreases quite considerably during the exchange of the empty spool for a parent roll.

Furthermore, an unwinding apparatus for continuous operation is known from U.S. Pat. No. 4,443,291, with which the web of a new parent roll located in a waiting position is led by a dancer roller and held with the web-beginning at a stationary cross member of the apparatus with vacuum. The web drawn off an expiring roll is led close to the web-beginning provided with an adhesive tape over two guide rolls which are mounted in swivellable frame. This is equipped between the guide rolls with a separating device for the web as well as with a pressure roll following in the direction of web travel, opposite the cross member. To join the web being drawn off the expiring roll with unreduced speed to the beginning of the web of the new roll, the frame is swung against the beginning of the web located in the waiting position. A knife of the separating device separates the running web, while the pressure roll presses the thus formed web-end against the beginning of the web and joins the two. The running web now accelerates the new roll to the required peripheral speed. Due to this joining technique of a running web to a stationary web-beginning, the unwinding apparatus is suitable either only for relatively low speeds or for winding rolls of small mass.

SUMMARY OF THE INVENTION

The invention is therefore based on the task of designing an unwinding apparatus of the type mentioned at the beginning in a way satisfying the requirements for intermittent operation.

This task is solved by the features of the present invention.

The following advantages are achieved with the solution:

The end of the unwound web is fixed in a defined position. Likewise, the new web-beginning is determined with regard to its position by attachment to the cross member of the splicing unit. The position of the new web-beginning is thus completely independent of the diameter of the parent roll.

The new web-beginning is attached in the waiting position of the parent roll independently of the winding operation currently taking place. The attaching operation therefore does not have a retarding effect on the changing operation of the empty spool for a parent roll.

The conveyance of the parent roll from the waiting position to the unwinding position, which is in any case necessary, is utilized to move the new web-beginning towards the fixed web-end. On reaching the unwinding position, the beginning of the web automatically meets the web-end, so that the splicing operation is performed simultaneously with the transport operation.

Additional advantages achieved through further features of the invention are as follows:

A structural component for web guiding, which is in any case available in the unwinding apparatus, is used to hold the web-end by means of an adaptation which can be carried out at low expense. If such a structural component cannot be used, a holding device made at low expense is also specially suitable.

A functionally reliable separating device with a low-wear separating element is disclosed.

A secure holding of the web during the separating process is ensured.

The attachment of the web to the cross member by swivelling the link into a position favorable for an operator is facilitated. In addition, by swivelling the link it can be ensured in a simple way that the new web-beginning takes up a position in which it meets the web-end during the splicing operation.

One embodiment of the invention is used when the web-end takes up a favorable position with regard to the position of the dog at the end of the transport operation of the parent roll. In this case the cross member can be arranged immediately at the dog in order to lead the web-beginning to the web-end.

An improvement of the splicing unit facilitates the fixing of the new web-beginning at the cross member without further aids.

The return and readiness of the splicing unit for the next changing operation is achieved at low expense.

BRIEF DESCRIPTION OF THE DRAWINGS

Embodiments of the invention are explained in greater detail below with reference to the drawings.

DESCRIPTION OF THE PREFERRED EMBODIMENTS

Figure 1:
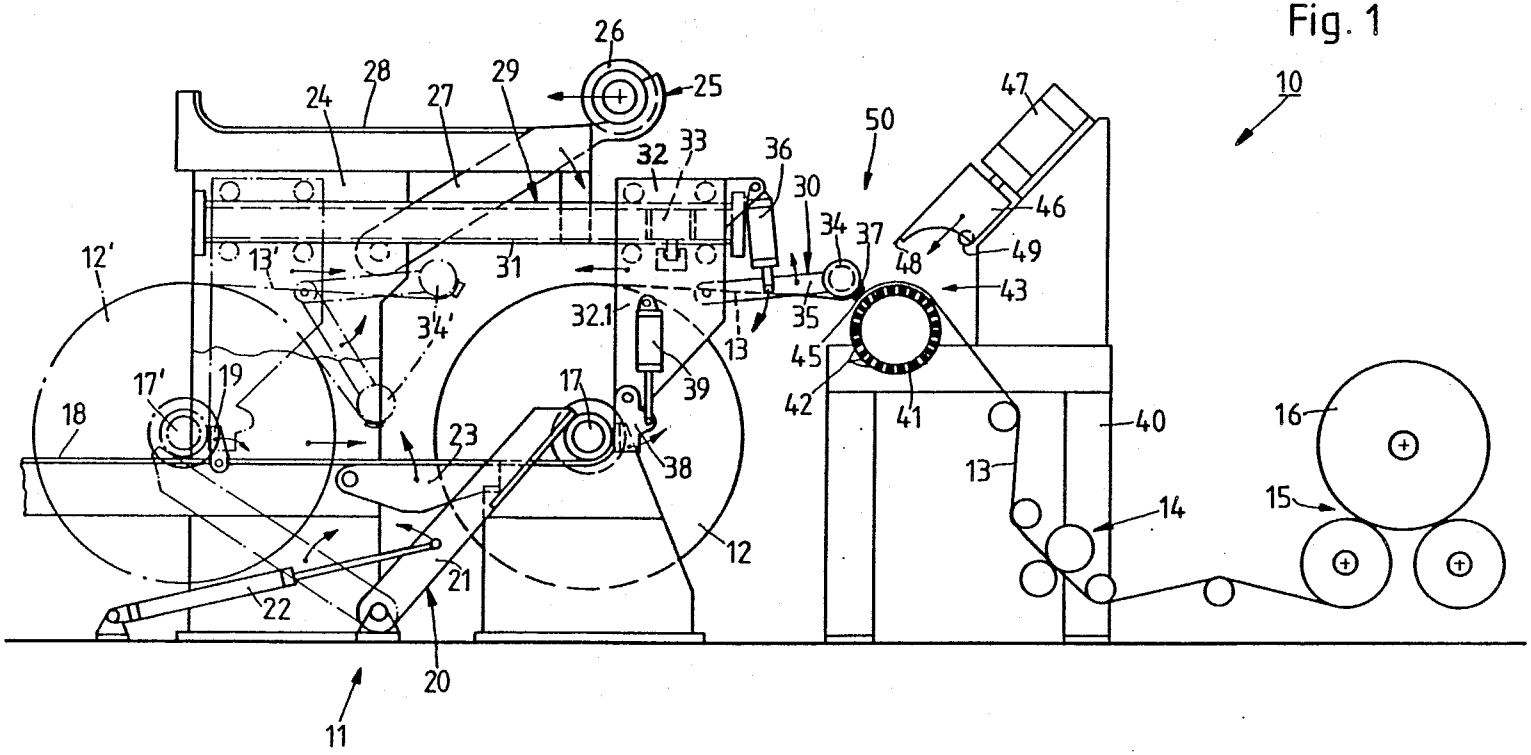
FIG. 1 shows as a first embodiment in schematic representation an unwinding apparatus with an unwind unit for a parent roll, with equipment for separating and holding the end of a web being unwound from a spool as well as with a splicing unit for joining the web-beginning of the parent roll to the web-end.

An unwinding apparatus 10 in FIG. 1 has an unwinding unit 11 in which parent rolls 12 coming out of a non-shown paper machine can be unwound. The web 13 expiring from the roll 12 is slit longitudinally in a working direction from left to right in a slitting station 14 and wound up into finished rolls 16 in a following two-drum winder 15.

The parent roll 12 has a full-length roll axle 17, the ends of which project beyond the end faces of the roll. With these axle ends the parent roll 12 is rotatably mounted on guideways 18 of the unwinding unit 11, extending on both sides of the roll end faces in a horizontal plane. The parent roll 12 takes up its unwinding position shown in solid lines in the drawing. At a distance from the parent roll 12 located in the unwinding position, fold-away stops 19 are arranged at the guideways 18 one behind the other in the drawing plane, which create a waiting position for a parent roll 12' indicated in chain lines. Further parent rolls coming from the paper machine can be laid with a hoist onto the guide ways 18 in the area not shown, to the left of the parent roll 12'.

For the transport of a parent roll 12 into the unwinding position, a conveyor 20 is provided. This comprises swing arms 21 arranged one behind the other in the drawing plane, which grip the ends of the roll axle 17 and are each movable by a thrust motor (piston-cylinder arrangement) 22.

To facilitate access by the operators of the unwinding apparatus 10 to the space between rolls 12' and 12 located in waiting position and unwinding position, respectively, the guideways 18 are provided with swivellable bridges 23.

Arranged on both sides of the guideways 18 are machine frames 24 (one behind the other in the drawing plane), which support a unit 25 for lifting an empty spool 26 out of the unwinding position. The lift-out unit 25 comprises two arms 27 (lying congruently one behind the other in the drawing), which can be swivelled by a non-shown drive between the unwinding position and the position reproduced in the drawing. The empty spool 26 is delivered by the lift-out unit 25 into a storage means 28 supported by the machine frames 24 for renewed use of the roll axle 17 in the paper machine.

The unwinding apparatus 10 is also equipped with a conveying device 29 for a splicing unit 30, with the conveying device 29 running at a distance above the guide ways 18 and parallel to these, integrated with the unwinding apparatus 11. The conveying device 29 has a drive with one cylinder 31 each fastened to the associated machine frame 24, on which one carriage 32 each is mounted to be longitudinally slidable with a dog 32.1 extending downwards against one end of the roll axle. To achieve a conveying movement of the dog 32.1, a rod-less piston 33 of the cylinder 31 is coupled to the carriage 32.

The splicing unit 30 comprises essentially a cross member 34 running parallel to the roll axle 17, this cross member having a length corresponding to the width of the web 13 processed in the unwinding apparatus 10. The cross member 34 comprises a tube which is connected at the ends to one link 35 each swivellably mounted at the corresponding dog 32.1. For generation of the swivelling movement thrust motors 36 mounted at the associated carriage 32 engage each link 35. Attached to the cross member 34 of the splicing unit 30 is the beginning of the web 37 of the parent roll 12 located in the unwinding position. Each dog 32.1 is connected with the axle 17 of this parent roll 12 by a stop 38 engaging at each end of the axle. This stop 38 is mounted so as to be able to be swivelled away over the roll axle by a thrust motor 39 arranged at the dog.

A guide roll 41 used to guide the web 13 between the parent roll 12 in the unwinding apparatus 11 and the slitting station is rotatably mounted at a machine frame 40 of the unwinding apparatus 10 which supports the slitting station 14. The guide roll 41 is subjected to vacuum and has holes 42 around the periphery and serves as a holding device for an end 45 of the unwound web 13 generated with a separating device 44.

The separating device 44 has a web-wide, box-shaped cross member 46 which is movable with thrust motors 47, each engaging at the ends of the cross member and supported at the machine frame 40, against the guide roll 41 of the holding device 43. The cross member 46, which has a contour matched to the guide roll 41 is equipped at its edge directed opposite to the direction of the web travel with a perforation comb 48 for separating the web 13. In addition, the cross member 46 of the separating device 44 is provided with a flexible tube 49 running parallel to its longitudinal extension, which serves to hold the web 13 at the guide roll 41 during the separating operation.

The splicing unit 30 supporting the beginning of the web 37 and the unit 43 holding the end of the web 45 form a device 50 in their direction for joining the beginning of the web to the end of the web, described furtherbelow.

Figure 3:
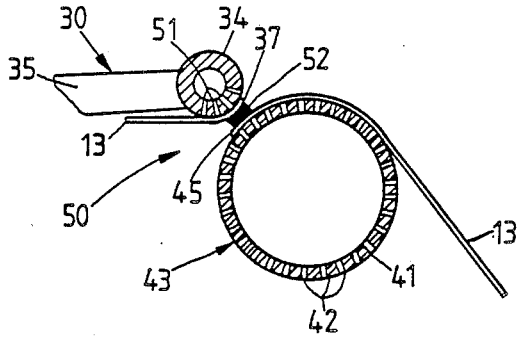
FIG. 3 shows as detail the splicing unit pressing the new web-beginning against the web-end positioned at the holding device to a larger scale than in FIG. 1.

During the unwinding process of the parent roll 12 located in the unwinding position, a new parent roll 12' is conveyed on the guideways 18 into its waiting position determined by the stops 19. The dogs 32.1 of the conveyor 29 are located in their position shown on the left in the drawing in chain lines, in which the stop 38 rests at each end of the roll axle 17'. The cross member 34 of the splicing unit 30 is swung downwards with the aid of the thrust motor 36 in clockwise direction. The bridge 23 of the guide ways 18 is swung into its vertical position so that an operator of the unwinding apparatus 10 can step into the space between the expiring parent roll 12 located in the unwinding position and the new parent roll 12' resting in the waiting position. The operator pulls a short piece of the new web 13 off the parent roll 12' and lays this web from underneath around the cross member 34 of the splicing unit 30. The hold of the web 13 on the cross member 34 can be ensured by the latter being designed as a suction tube which can be subjected to vacuum, having a multiplicity of holes 51 in the peripheral area wrapped by the web (FIG. 3). The operator now makes a cut along the cross member 34 over the entire web width and thus forms a new web-beginning 37. On the free side of the web-beginning 37 the operator applies a double-sided adhesive tape 52 extending at right angles to the direction of web travel. This adhesive tape 52 can also be used instead of the suction holes 51 to attach the new web-beginning 37 to the cross member 34 if it is pulled over the cut edge of the web-beginning 37 and bonded with a small part of its width to the cross member 34. When the operator has stepped out of the unwinding apparatus 11, the cross member 34 of the splicing unit 30 is swung with the thrust motors 36 in counterclockwise direction into its upper position shown in chain lines in FIG. 1. The cross member 34 with attached new web-beginning now extends in a plane running parallel to the guide ways 18, in which lies the web-end 45 located at the holding device 43. The bridges 23 are swung down so that they take up their position in line with the guide ways 18.

With the completion of a roll set 16 wound on the two-drum winder 15 the unwinding apparatus 10 is stopped. At the same time, the parent roll 12 located in the unwinding position is almost completely emptied of the web 13.

Figure 2:
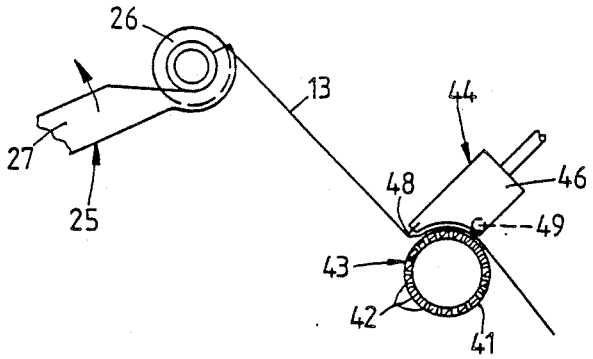
FIG. 2 shows as detail the web running between the spool on the one hand and the separating device and holding device on the other hand during the separating operation.

The cross member 46 of the separating device 44 is moved against the guide roll 41 of the holding device 43 with the thrust motors 47. The flexible tube 49 of the separating device 44 presses the unwound web 13 against the guide roll 41 of the holding device. The lift-out unit 25 is now swung downwards in clockwise direction so that its arms 27 grip the ends of the roll axle 17. By swivelling the arms 27 in counterclockwise direction the empty spool 26 is lifted out of the unwinding position and transported to the storage area 28. During this lift-out movement, the web 13 lying above the perforation comb 48 of the separating device 44 is tightened and separated at right angles to the direction of web travel (FIG. 2). While the empty spool 26 rolls out of the lift-out unit 25 into the storage area 28, the guide roll 41 of the holding device 43 is subjected to vacuum and the cross member 46 of the separating device 44 is pulled back into its initial position shown in FIG. 1. The web-end 45 of the unwound web 13 is thus fixed to the holding device 43. If necessary, the guide roll 41 must be locked in this position to ensure the position of the web-end 45 for the succeeding splicing operation.

The thrust motors 22 of the conveyor 20 are now put into operation so that the swing arms 21 moved in clockwise direction out of their position shown in chain lines in FIG. 1 and engaging at the roll axis 17' of the new parent roll 12' transport the new wound roll out of the waiting position into the unwinding position. Since the dogs 32.1 of the conveyor 29 engage with its stop 38 at the end of the roll axis 17', the splicing unit 30 is at the same time transported out of its position shown in chain lines in FIG. 1 into its position reproduced in solid lines. When the new parent roll 12' has reached its unwinding position, the new web-beginning 37 attached to the cross member 34 of the splicing unit 30 also meets the web-end 45 (FIG. 3) held at the guide roll 41. The adhesive tape 52 creates a secure joining of the web-beginning 37 to the web-end 45. The bonding can be improved further if the splicing unit 30 with the thrust motors 36 is pressed additionally against the guide roll 41 of the holding device 43. After bonding, the cross member 34 of the splicing unit 30 is lifted with the thrust motors 36 in counterclockwise direction so that the attached web-beginning 57 detaches itself from the cross member. Now the vacuum in the guide roll 41 is stopped and the blocking of the roll released. The unwinding apparatus 10 is thus again ready for operation.

For the preparation of the next splicing operation the stop 38 of the dogs 32.1 is disengaged from the roll axis 17 with the thrust motors 39 and the carriages 32 with the splicing unit 30 are taken back by the conveyor 29 into the initial position shown in chain lines.

Figure 4:
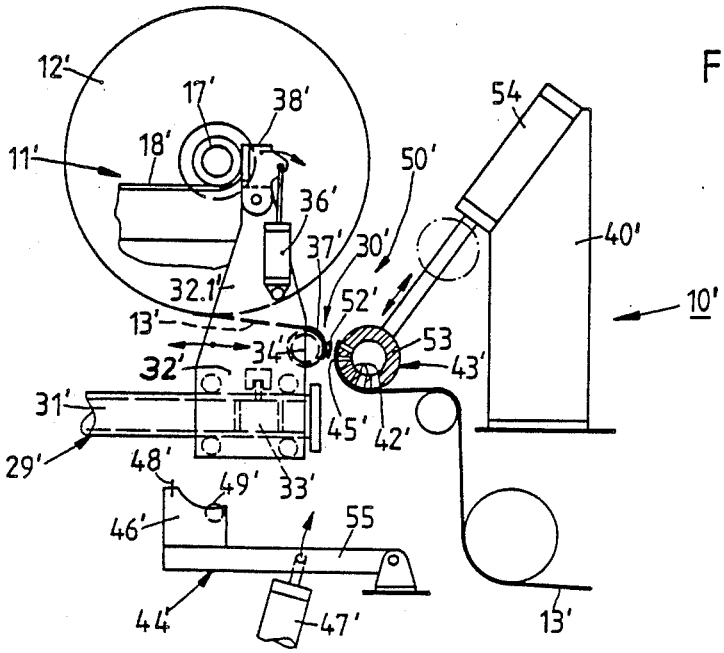
FIG. 4 shows as a second embodiment a variation of the holding device, the separating device and the splicing unit as compared with the embodiment shown in FIG. 1.

An unwinding apparatus with a web run between the unwinding apparatus 11 and the slitting station 14 deviating from the embodiment as per FIG. 1 may have no structural component available on which the web-end can be held. In such a case, the aforementioned embodiment can be modified according to the variant shown in FIG. 4. The reference symbols known from the previous embodiment are also used for assemblies and structural components of similar function of the unwinding device reproduced in sections in FIG. 4, and namely provided with an additional apostrophe.

The apparatus 10' is provided with a holding device 43' independent of the web run, which has a web-width tube 53 running parallel to the roll axis 17'. This tube is connected at the end to thrust motors 54, which are supported at the machine frame 40' of the unwinding apparatus 10'. In the non-working position of the holding device 43' the tube 54 takes up the position shown with a chain-lined circle. For preparation of the splicing operation the tube 53 is moved with the thrust motors 54 against the web 13' so that the periphery of the tube is partially wrapped by the web. In this peripheral area the tube 53 is provided with holes 42' and is subjected to vacuum.

A separating device 44' arranged underneath the holding device 43' has a cross member 46' matched to the contour of the tube 53 with a perforation comb 48' as well as a flexible tube 49'. The web-wide cross member 46' is mounted at the ends in arms 55 with which one thrust motor 47' each engages. With the help of the thrust motors 47' the separating device 44' is swivellable clockwise against the holding device 43' so that the flexible tube 49' presses the web 13' against the tube 53. Through lifting of the empty spool (not shown) in the way described in the embodiment as per FIG. 1 out of the unwinding apparatus 11' the web 13' can be tightened between the empty spool and the tube 53 of the holding device 43' and separated by the perforation comb 48'. If the just formed end 45' of the web 13' is held by means of the application of vacuum at the tube 53, the separating device 44' can be swung back into its shown position.

A new parent roll 12' supported on the guide ways 18' has been moved by a conveyor as per FIG. 1 (not shown) into its unwinding position. The ends of the axle 17' of the parent roll 12' have moved carriage 32' toward the holding device 43' by engagement at the stops 38' of the dogs 32.1'. The dogs 32.1' are led with the their carriages 32' between the waiting position and the unwinding position of the parent roll 12' each on a conveyor 29' extending underneath the guide way 18'. The conveyor 29' comprises, as in the embodiment according to FIG. 1, one cylinder 31' each running parallel to the guide ways 18' with a rod-less piston 33' which is coupled to the corresponding carriage 32'. Both dogs 32.1' are joined on their side facing the holding device 43' by a web-wide cross member 34' of a splicing unit 30'. This cross member 34' is arranged in a parallel plane with respect to the guideways 18', in which the web-end 45' located at the holding device 43' extends. The cross member 34' runs underneath the periphery of the largest parent roll processable in the unwinding apparatus 11'.

The beginning 37' of the web is attached to the cross member 34' of the splicing unit 30', configured as a suction tube, in the waiting position of the parent roll 12' in the same way as with the embodiment as per FIG. 1 and has been provided with an adhesive tape 52'. The new web-beginning 37' meets together with its adhesive tape 52' the web-end 45' located at the holding device 43'. The contact of the adhesive tape 52' at the web-end 45' can be assisted by a movement directed by the conveyor 43'. Thus the splicing unit 30' in conjunction with the holding device 43' form in the embodiment as per FIG. 4 a device 50' to join the end of the web 45' to the beginning of the web 37'.

When the splicing operation has been carried out, the tube 53 of the holding device 43' is moved with the thrust motors 43' into its initial position (shown in chain lines). The stops 38' of the dogs 32.1' are disengaged from the ends of the axle 17' of the parent roll 12' by actuation of the thrust motors 36'. The conveyor 29' moves the splicing unit 30' under release of the cross member 34' from the web 13' into its position allocated to the waiting position of a new parent roll. The unwinding apparatus 10' can now be put into operation for the performance of a new winding operation.

What is claimed is:

1. An apparatus for unwinding a paper web wound as a parent roll on a roll axle for subsequent handling by a succeeding rewind station, said apparatus comprising:

an unwinding unit having guideway means for receiving the ends of the roll axle of the parent roll, the parent roll being movable between a waiting position and an unwinding position on said guideway means;

means for moving the parent roll from the waiting position to the unwinding position;

separating means for separating the web unwound from the parent roll substantially perpendicularly to the direction of web travel;

holding means for holding the end of the unwound web parallel to the roll axle on web standstill;

lifting means for lifting out of the unwinding position the roll axle of an expired parent roll whose unwound web has been separated by said separating means;

joining means for joining the end of an unwound web to the beginning of the web of a parent roll located in the unwinding position, said joining means including splicing means having a cross member arranged substantially parallel to the roll axle for receiving the beginning of the web of a parent roll located in the waiting position; and a carriage movable substantially parallel to said guideway means and carrying said splicing means, said carriage having a dog engaging an end of the roll axle such that the parent roll in moving from the waiting position to the unwinding position move said carriage and the cross member of said splicing means with the beginning of the web against said holding means with the end of the unwound web, such that the webs come to lie one above the other and are joined together.

2. An apparatus according to claim 1, in which said holding means includes a guide roll serving to guide the unwound web, the guide roll having a shell provided with holes around the periphery; and means for supplying a vacuum to the shell.

3. The apparatus according to claim 2, in which said separating means includes a perforation comb positionable against the web ahead of said holding means in the direction of web travel, the perforation comb separating the web on lifting of an unwound roll axle out of the unwinding position.

4. The apparatus according to claim 1, in which said holding means includes a tube extending across the width of the web which is pressed substantially perpendicularly to the direction of web travel into the web tensioned and wound off the roll, the tube being provided with holes around the periphery in that area wrapped by the web; and means for supplying a vacuum to the tube.

5. The apparatus according to claim 4, in which said separating means includes a perforation comb positionable against the web ahead of said holding means in the direction of web travel, the perforation comb separating the web on lifting of an unwound roll axle out of the unwinding position.

6. The apparatus according to claim 1, in which said separating means includes a perforation comb positionable against the web ahead of said holding means in the direction of web travel, the perforation comb separating the web on lifting of an unwound roll axle out of the winding position.

7. The apparatus according to claim 6, in which said separating means includes a flexible tube pressing the web against said holding means.

8. The apparatus according to claim 1, in which the cross member of said splicing means is swivellably mounted to the dog of the carriage by a link lying in a plane substantially parallel to the guideway, in which plane the web-end located at said holding means lies.

9. The apparatus according to claim 8, in which the cross member of said splicing means is configured as a suction tube.

10. The apparatus according to claim 1, in which the cross member of said splicing unit is arranged at the dog of the carriage in a plane parallel to the guideway, in which plane the web-end located at the holding device extends.

11. The apparatus according to claim 10, in which the cross member of said splicing means is configured as a suction tube.

12. The apparatus according to claim 1, in which the carriage has drive means for taking the dog from the unwinding position back into the waiting position, the dog having a stop which can be brought out of engagement with the end of the roll axle.

* * * * *